US012311249B2

(12) United States Patent
Piombino et al.

(10) Patent No.: US 12,311,249 B2
(45) Date of Patent: May 27, 2025

(54) PROTECTIVE PAD FOR PROTECTION FROM IMPACT AND A PROTECTIVE GARMENT USING THE SAME

(71) Applicant: BSN SPORTS, LLC, Farmers Branch, TX (US)

(72) Inventors: Don Piombino, Farmers Branch, TX (US); Bastien Jourde, Montreal (CA)

(73) Assignee: BSN SPORTS, LLC, Farmers Branch, TX (US)

( * ) Notice: Subject to any disclaimer, the term of this patent is extended or adjusted under 35 U.S.C. 154(b) by 221 days.

(21) Appl. No.: 17/014,046

(22) Filed: Sep. 8, 2020

(65) Prior Publication Data

US 2020/0398143 A1 Dec. 24, 2020

Related U.S. Application Data

(63) Continuation of application No. 15/840,605, filed on Dec. 13, 2017, now Pat. No. 10,765,928.
(Continued)

(51) Int. Cl.

| | |
|---|---|
| ***A63B 71/12*** | (2006.01) |
| ***A41D 1/089*** | (2018.01) |
| ***A41D 13/05*** | (2006.01) |

(52) U.S. Cl.

CPC ..... *A63B 71/1225* (2013.01); *A41D 1/089* (2018.01); *A41D 13/0506* (2013.01); *A41D 13/0531* (2013.01); *A41D 13/0537* (2013.01); *A41D 13/0543* (2013.01); *A41D 13/0581* (2013.01); *A41D 2300/20* (2013.01); *A63B 2071/1233* (2013.01); *A63B 2071/1241* (2013.01)

(58) Field of Classification Search

CPC ..... A63B 2071/1241; A63B 71/1225; A41D 13/0506; A41D 13/05; A41D 13/015; A41D 13/0156; A41D 13/0158; A41D 2300/20

USPC ..... 2/467

See application file for complete search history.

(56) References Cited

U.S. PATENT DOCUMENTS

| | | | |
|---|---|---|---|
| 759,833 | A | 5/1904 | Stall |
| 2,266,886 | A | 12/1941 | McCoy |

(Continued)

OTHER PUBLICATIONS

Bike Athletic Company, Catalog, Oct. 2002, pp. 2-8.
Leatt Product, Nov. 2017.
Acerbis Product, Nov. 2017.

*Primary Examiner* — Katherine M Moran
(74) *Attorney, Agent, or Firm* — FINNEGAN, HENDERSON, FARABOW, GARRETT & DUNNER LLP

(57) ABSTRACT

A protective pad for protection from impact and a protective garment using the protective pad may be provided. In one implementation, the protective pad may include a foam part and a plate part. The foam part may include a plurality of channels, a plurality of cutout portions, and a plate accommodating section for receiving the plate part. The channels may be formed in a first surface of the foam part and the plate accommodating section may be formed in a second surface opposite to the first surface. The cutout portions of the foam part may include through-holes formed in the foam part from the first surface to the second surface. The plate part may be arranged on the plate accommodating section of the foam part, and the plate part may include a plurality of cutout portions that are substantially aligned with the cutout portions of the foam part.

14 Claims, 20 Drawing Sheets

Related U.S. Application Data

(60) Provisional application No. 62/498,133, filed on Dec. 16, 2016.

(56) References Cited

U.S. PATENT DOCUMENTS 4,035,844 A 7/1977 Atack et al.
4,486,901 A 12/1984 Oonzis
4,513,449 A 4/1985 Donzis
5,168,576 A 12/1992 Krent
5,322,730 A 6/1994 Ou
5,557,804 A 9/1996 Ovortrup
5,680,657 A 10/1997 Valtakari
5,701,611 A 12/1997 Rector et al.
5,781,935 A 7/1998 Bassett et al.
5,920,915 A 7/1999 Bainbridge et al.
6,032,300 A 3/2000 Bainbridge et al.
6,079,056 A 6/2000 Fogelberg
6,093,468 A * 7/2000 Toms ..... A41D 13/0506 2/22
6,279,160 B1 8/2001 Chen
6,336,220 B1 1/2002 Sacks et al.
6,845,522 B2 1/2005 Beland
6,880,269 B2 4/2005 Falone et al.
7,168,104 B2 1/2007 Tobergte
7,389,547 B1 6/2008 Wiens
D582,608 S 12/2008 Palmer
D633,688 S 3/2011 Turner
8,220,072 B2 7/2012 Dodd
8,272,073 B2 * 9/2012 Arensdorf ..... A41D 1/08 2/228
9,149,084 B2 10/2015 Turner
9,352,531 B2 5/2016 Berns
9,615,611 B2 4/2017 Wyner
9,962,902 B2 5/2018 Losio
10,021,922 B2 7/2018 Brandt
2009/0276933 A1 11/2009 Dodd
2010/0319097 A1 12/2010 Turner
2013/0025037 A1 1/2013 Turner
2013/0234376 A1 9/2013 Frey
2015/0297973 A1 * 10/2015 Beers ..... A41D 13/015 2/22

* cited by examiner

PROTECTIVE PAD FOR PROTECTION FROM IMPACT AND A PROTECTIVE GARMENT USING THE SAME

CROSS-REFERENCE TO RELATED APPLICATIONS

This application is a continuation of U.S. patent application Ser. No. 15/840,605, filed Dec. 13, 2017, which issued as U.S. Pat. No. 10,765,928 on Sep. 8, 2020, which claims the benefit of priority from U.S. Provisional Application No. 62/498,133, filed Dec. 16, 2016, both of which are hereby incorporated by reference in their entireties.

BACKGROUND

This invention relates to a protective garment (girdle) designed to protect an athlete's legs, hip, and tailbone from impact forces incurred during sports activities, such as football, rugby, skiing, ice hockey, and other extreme sports.

Football girdles are long shorts worn under pants that fit snugly (compress) against the body and have a plurality of slots designed to receive pads (either removable or permanent pads) in order to protect the athlete in the event of an impact force acting thereon. These pads are typically located at the hips, tailbone, and thighs. Examples of protective sport garments are disclosed in the following U.S. patents: U.S. Pat. No. 759,833 (padded garment comprising a trouser having a plurality of pads permanently secured to the trouser with stitching to the outer surface of its body and legs): U.S. Pat. No. 4,035,844 (trouser undergarment made of stretchable material having pockets at the knees and thighs designed to receive removable padding, e.g., pockets stitched with the top open portion); U.S. Pat. No. 7,389,547 (garment having protective shields attached to the legs with releasable hook/loop fastener that allows the position of the shields on the legs to be adjusted and the shields to be removed from the legs).

The objects and advantages of the invention are embodied in the following description in connection with the accompanying drawings of a preferred embodiment of the protective garment.

SUMMARY

The invention provides a protective pad for protection from impact and also allows a user's body heat to efficiently and effectively exit the user's body surface even in locations of the user's body that are covered, padded and protected. The pad design allows for moisture management properties and tactical impact energy dispersion and also reduces the weight of the pads and covering without compromising the protection of the user.

The invention also includes a protective garment, e.g., a girdle or shorts for wearing under pants. The protective garment includes pads for protecting various parts of the body such as thighs, hips and tailbone.

A first aspect of the invention is a protective pad for protection from impact comprising: a foam part, and a plate part, wherein the foam part includes a plurality of channels, a plurality of cutout portions, and a plate accommodating section for receiving the plate part, the plurality of channels are formed in a first surface of the foam part and the plate accommodating section is formed in a second surface opposite to the first surface, the plate accommodating section being a recess in the second surface of the foam part, and the plurality of cutout portions of the foam part are through-holes formed in the foam part from the first surface to the second surface, wherein the plate part is arranged on the plate accommodating section of the foam part, and the plate part includes a plurality of cutout portions that are substantially aligned with the cutout portions of the foam part, the plurality of cutout portions of the plate part are through-holes formed in the plate part from a first surface adjacent to the foam part to a second surface opposite to the first surface, and the plurality of cutout portions of the plate part are tapered inward from the second surface towards the first surface.

In a second aspect of the invention, an opening percentage defined by the total area of all of the openings of the cutout portions of the plate part at the first surface of the plate part relative to an area of the first surface of the plate part defined by the outer perimeter of all of the plurality cutout portions of the plate part combined is 10 to 50%.

In a third aspect of the invention, the opening percentage is 20 to 30%.

In a fourth aspect of the invention, the plate part includes a stitching tab portion arranged near an outer edge around the plate part, and the plate part is stitched to the foam part at the stitching tab portion of the plate part and at the plate accommodating section of the foam part.

In a fifth aspect of the invention, the thickness of the foam part at a portion of the foam part not within the plate accommodating section and not within a channel is 6 to 20 mm.

In a sixth aspect of the invention, the plurality of cutout portions of the foam part and the plurality of cutout portions of the plate part are arranged in rows, the shape of the plurality of cutout portions of the foam part and the plurality of cutout portions of the plate part is substantially triangular, and adjacent rows of the cutout portions of the foam part and the plate part are formed as mirror-images from each other.

A seventh aspect of the invention is a protective garment for protection from impact forces comprising: a garment for wearing under pants having a body portion and a pair of left and right leg portions, a thigh pad on each of the left and right leg portions, the thigh pad comprising a protective pad as in the first aspect of the invention, a hip pad on each of a left and right side of the body portion, and a tailbone pad located at a back side of the body portion.

In an eighth aspect of the invention, the hip pads and the tailbone pad comprise a foam part including a plurality of channels and a plurality of cutout portions, the plurality of channels are formed in a first surface of the foam part, and the plurality of cutout portions are through-holes formed in the foam part from the first surface to a second surface that is opposite to the first surface.

In a ninth aspect of the invention, the plate part of the thigh pad includes a stitching tab portion arranged near an outer edge around the plate part, and the plate part is stitched to the foam part at the stitching tab portion of the plate part and at the plate accommodating section of the foam part, wherein the foam part of the thigh pad includes a stitching tab portion arranged near an outer edge around the foam part, and the foam part of the thigh pad is stitched to the shorts.

DETAILED DESCRIPTION

Several embodiments of the invention are described in detail below with reference to the accompanying drawings. The drawings show embodiments of the invention drawn to scale. The embodiments as shown in the figures and discussed below are exemplary of the invention and do not limit the scope of the invention to that explicitly shown or described.

With reference to the drawings, one embodiment of this invention includes a protective garment (e.g., girdle) 1 having a body portion 1*a* and a pair of left and right leg portions 1*b*. The body portion 1*a* includes a flexible waist band adapted to surround a person's (athlete) abdomen. The leg portions 1*b* extend above the person's knees and surround the person's thighs. However, the leg portions may also be designed to extend past the knees. The garment 1 is made from elastic, washable and durable fabric. An example of such fabric is Lyrcra®, Spandex, and/or mesh. A plurality of pads are provided at locations of the garment 1 to absorb impact forces, such as from direct or indirect contact with opposing player(s), object(s), or ground surface. The locations of the pads are selected to protect the person's thighs, hips, and tailbone.

Figure 1:
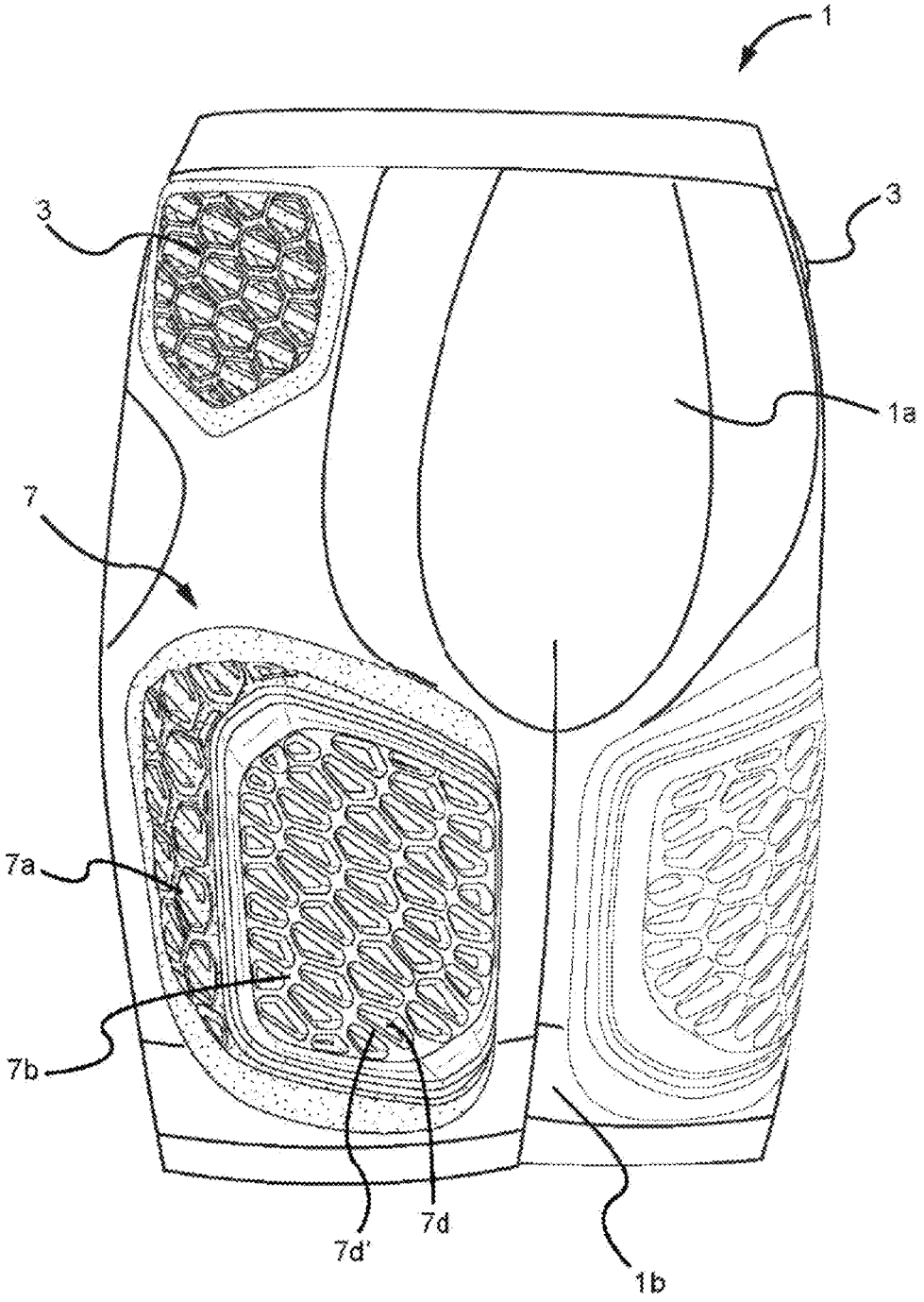
FIG. 1 is a perspective view of a protective garment having pads in accordance with one embodiment of the invention.
Figure 2:
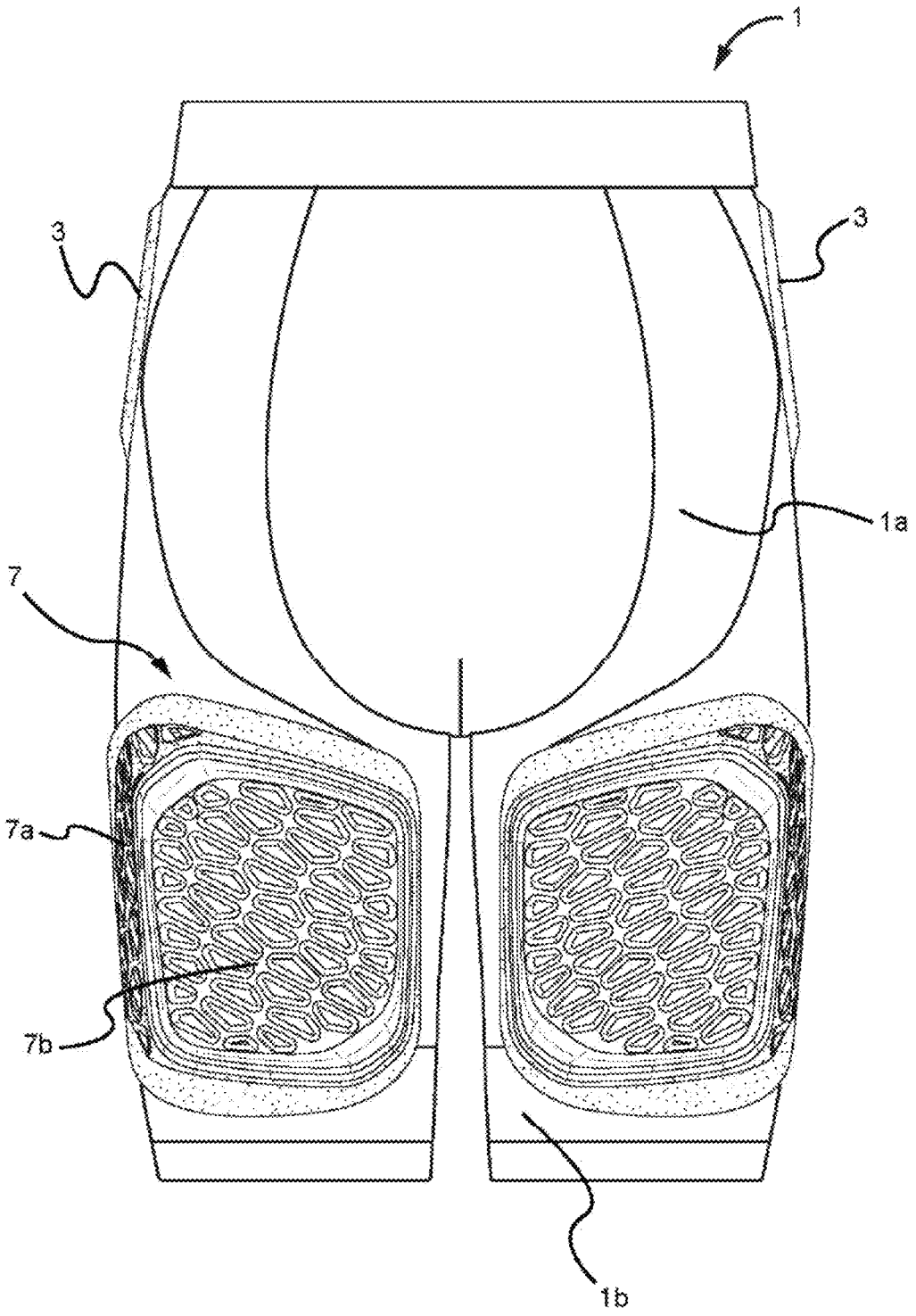
FIG. 2 is a front view of the protective garment having pads shown in FIG. 1 in accordance with one embodiment of the invention.
Figure 3:
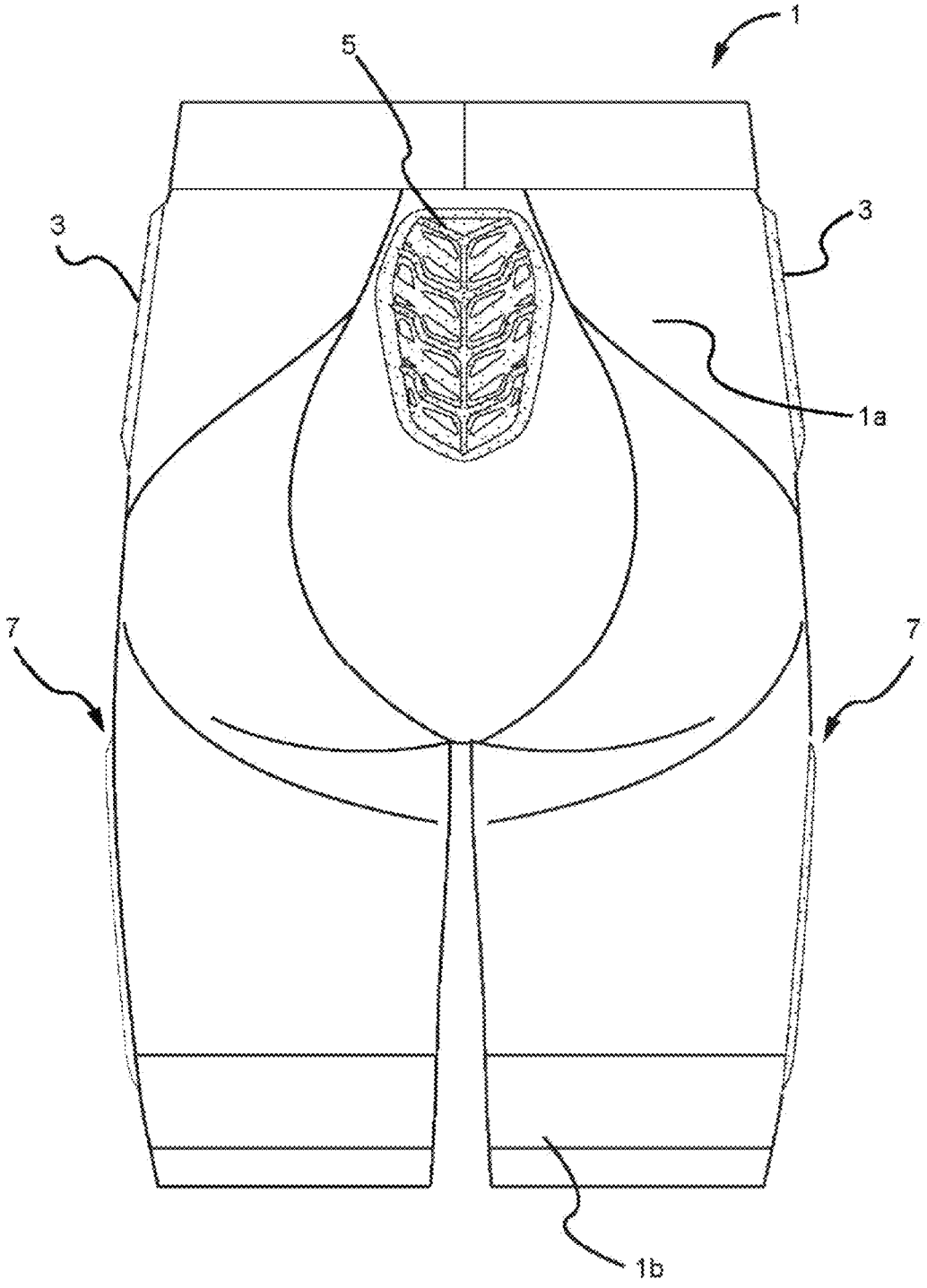
FIG. 3 is a back view of the protective garment having pads shown in FIG. 1 in accordance with one embodiment of the invention.
Figure 4:
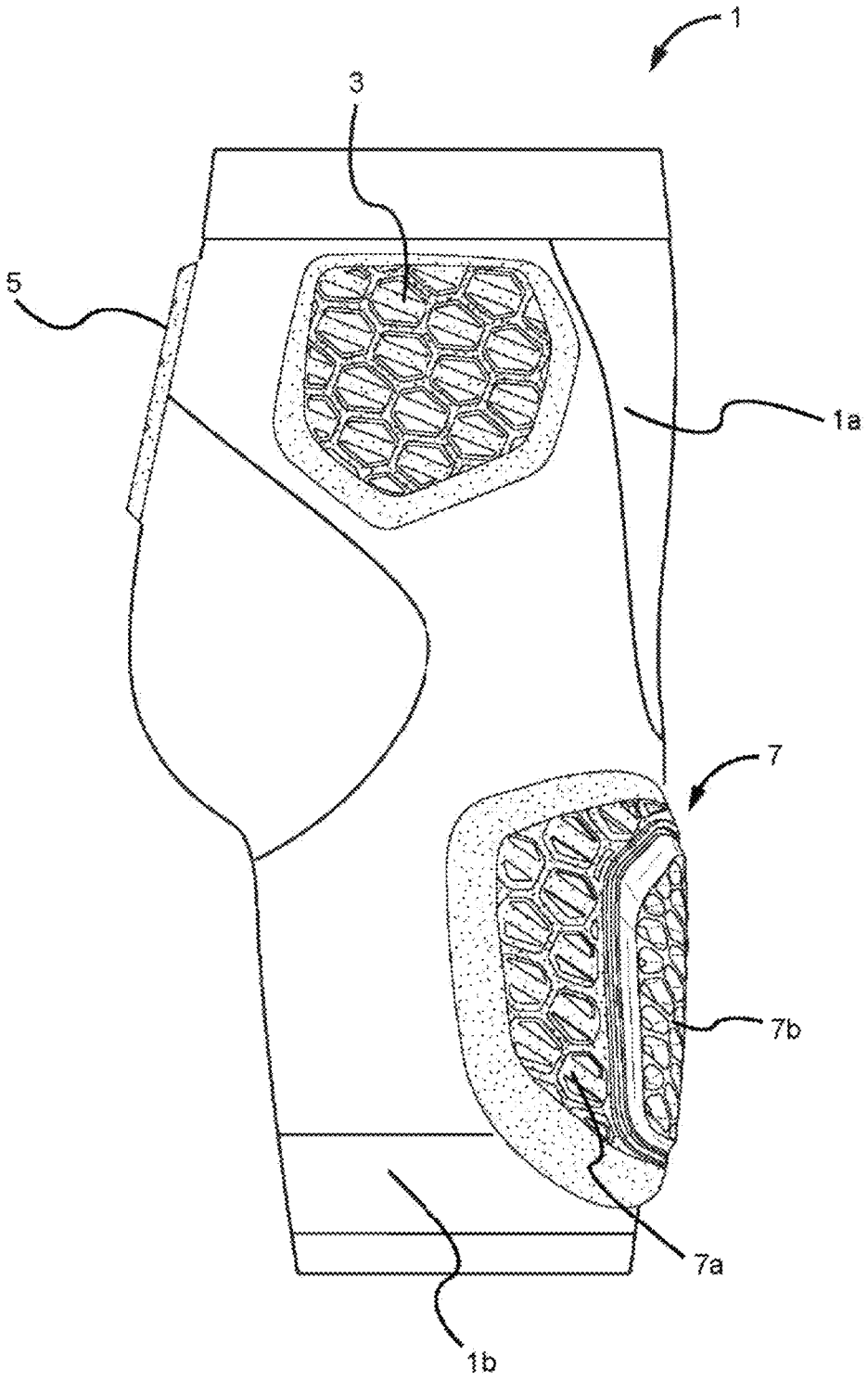
FIG. 4 is a left side view the protective garment having pads shown in FIG. 1 in accordance with one embodiment of the invention.
Figure 5:
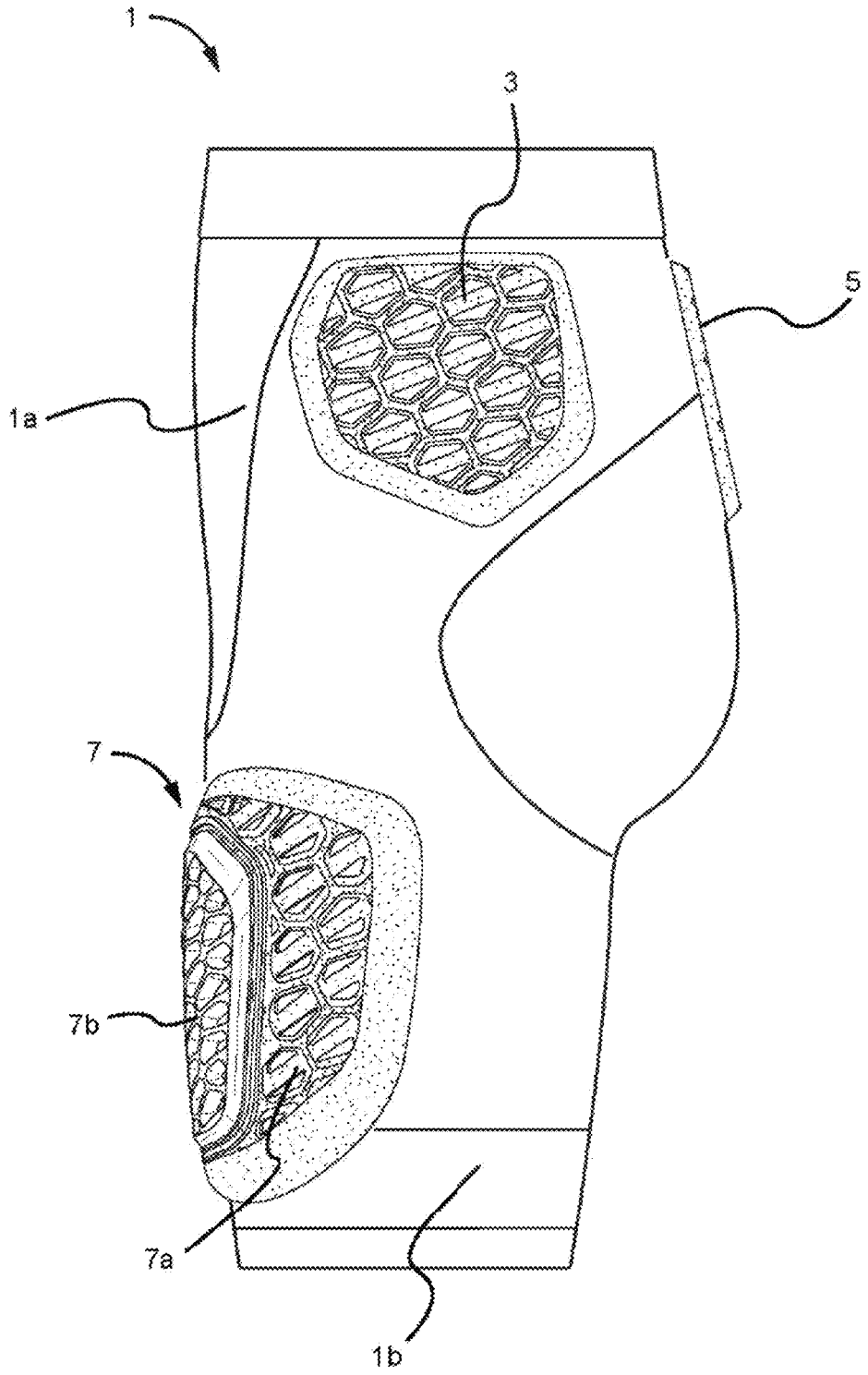
FIG. 5 is a right side view of the protective garment having pads shown in FIG. 1 in accordance with one embodiment of the invention.
Figure 6:
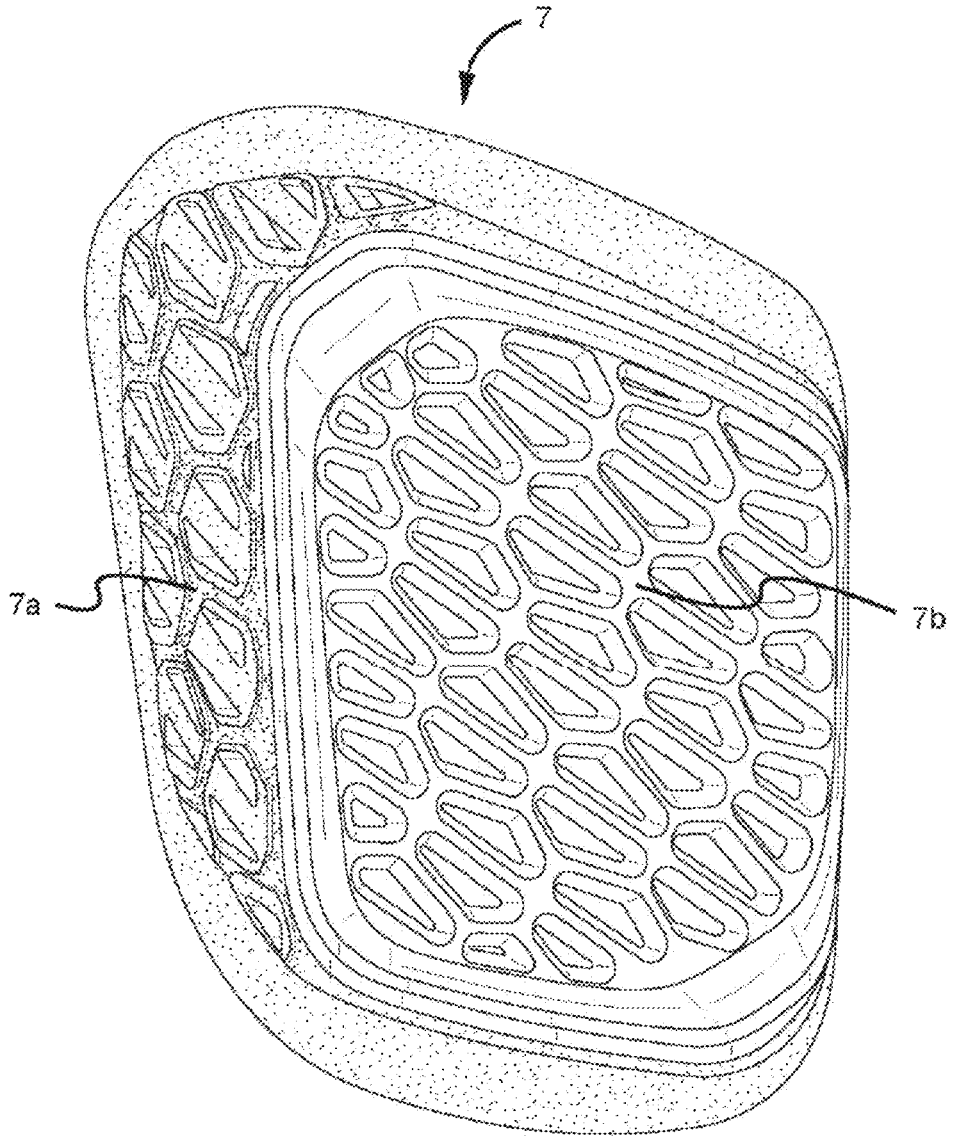
FIG. 6 is a perspective view of a thigh pad in accordance with one embodiment of the invention.

As shown in FIGS. 1 and 3, the body portion 1*a* includes left and right hip pads 3 and a tailbone pad 5. As shown in FIG. 2, the leg portions 1*b* includes left and right thigh pads 7. As shown in FIGS. 6-12, the thigh pad 7 comprises a foam part 7*a* and a thigh pad plate 7*b*. The thigh pad foam part 7*a*, hip pads 3, and tailbone pad 5 may be formed from a known foam type, including EVA, LDPE, HDPE, PU, VN, or visco-elastic foam. These components may be formed by heat compressed foam, molded, or injection foam. The foam thickness may be 5-20 mm, preferably 8-12 mm, most preferably 10 mm. The thigh pad plate 7*b* may be formed from a known hard plastic material, such as ABS, PP, HDPE, PC, or a composite (glass or carbon based), or any of blend of these resins, or any of these resins mixed with 0-15% glass or carbon reinforcement.

One objective of the novel design for the various pad features included in the protective garment described herein is to allow a user's body heat to efficiently and effectively exit the user's body surface even in locations of the user's body that are covered, padded, and protected. The pad design allows for moisture management properties and tactical impact energy dispersion.

Figure 13:
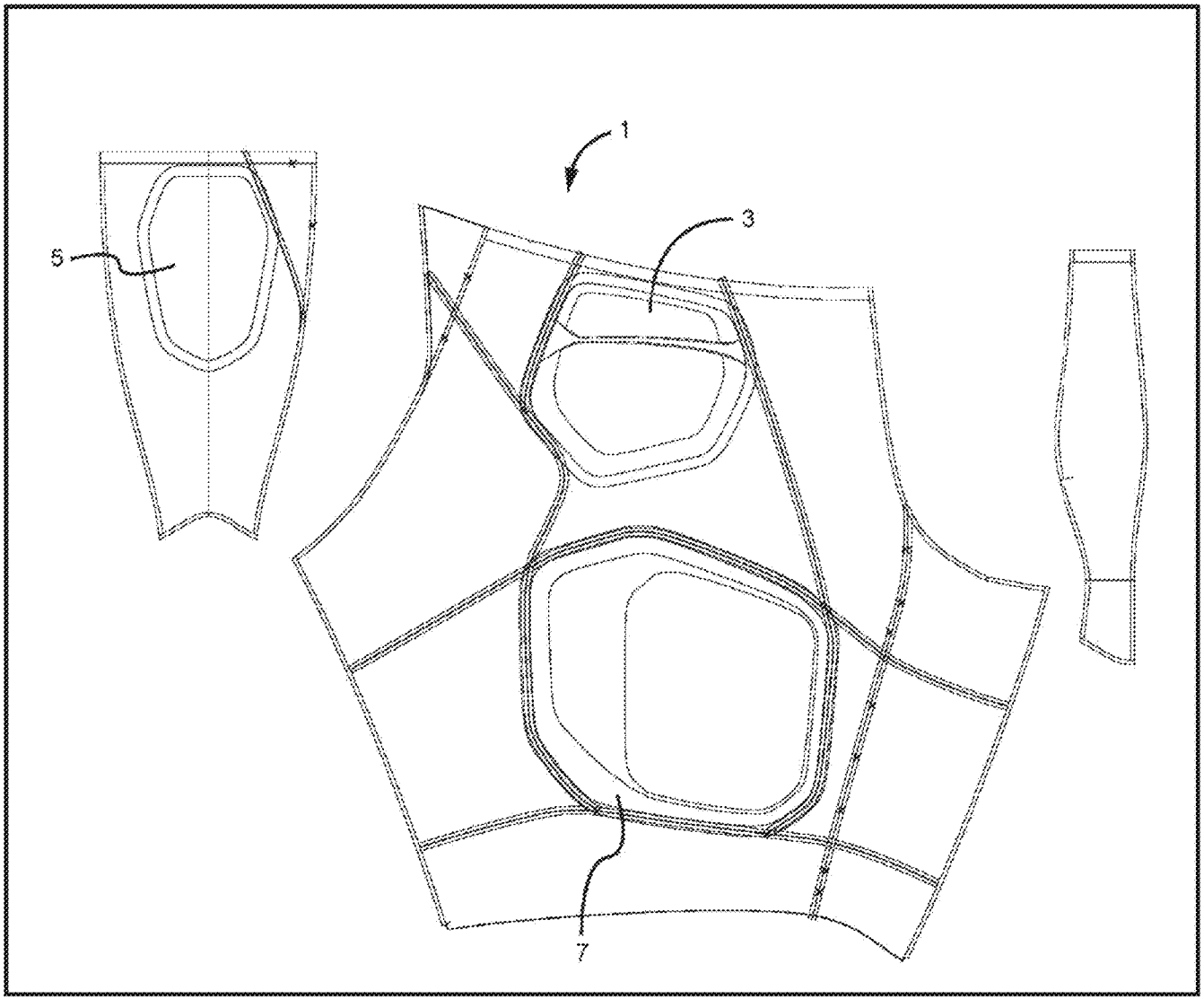
FIG. 13 illustrates pattern for protective garment in accordance with one embodiment of the invention.

FIG. 13 illustrates an embodiment of a pattern used to form the protective garment 1. The pattern includes a plurality of cut lines and fold lines designed to form the overall shape of the protective garment and to accommodate the pads attached (stitched) to an outside surface of the protective garment 1. The protective garment 1 includes several panel portions separated by cut lines. The panel portions may be formed of mesh or lycra material, depending on the desired function of the panel portion.

Figure 14:
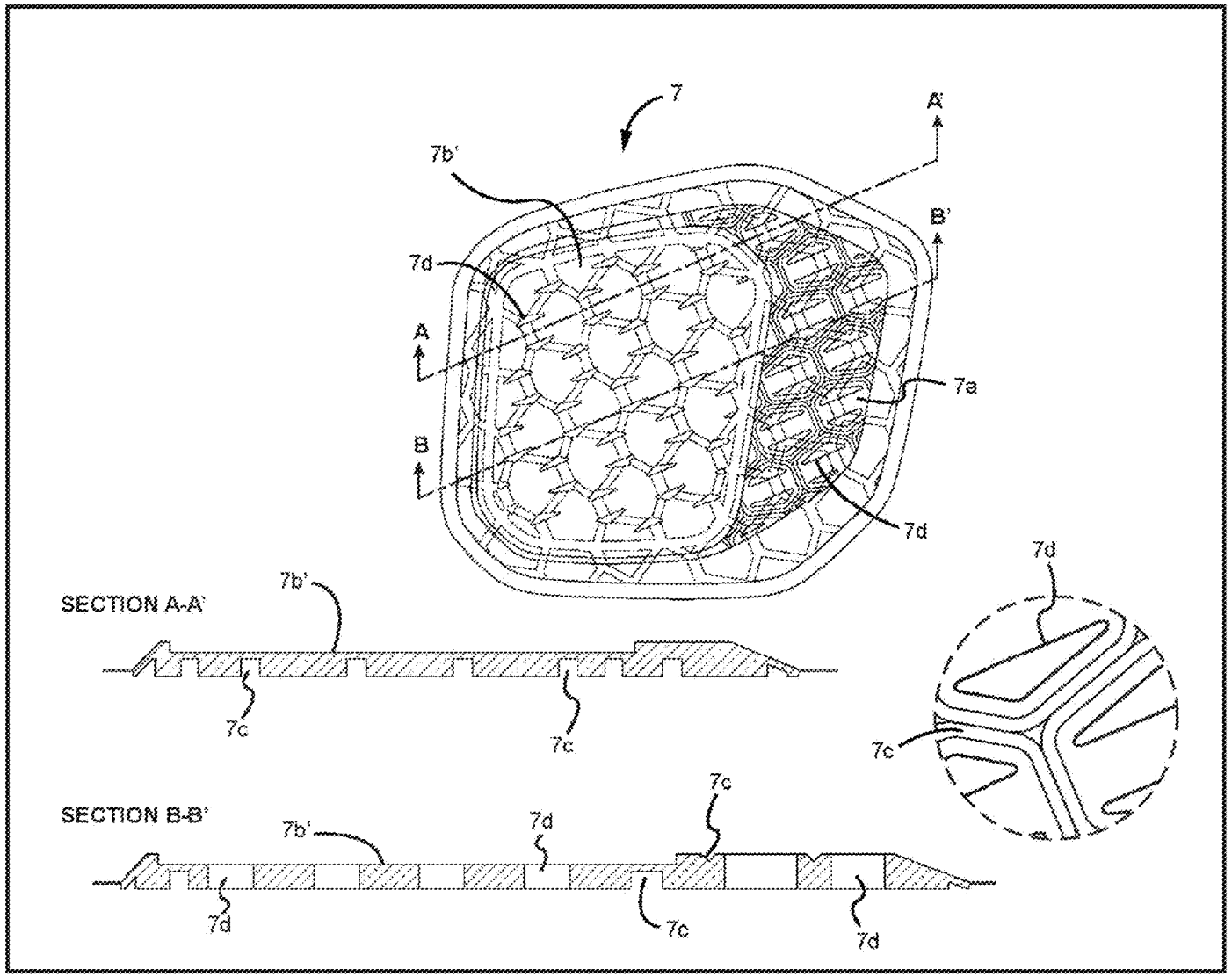
FIG. 14 is a thigh pad foam, including sectional views A-A' and B-B' in accordance with one embodiment of the invention.

FIG. 14 illustrates a foam part 7*a* of left thigh pad 7, without the pad plate 7*b*. As shown in section A-A', the foam part 7*a* is formed with a plurality of channels 7*c*, pad plate accommodating portion 7*b*', and a first plurality of cutout portions 7*d*. The thickness of foam part 7*a* may be 5-20 mm, preferably 8-12 mm, most preferably 10 mm. In this embodiment, the foam plate accommodating portion 7*b*' is a recessed portion having a depth of 3 mm and thickness of 7 mm; however, it is known to use a dimension suitable to accommodate a desired pad plate 7*b* thereon. Each of the channels 7*c* is preferably 5 mm deep and formed such that at least 2 mm of material remains at an upper surface thereof. For example, in the portion of 10 mm foam part 7*a* that is not the foam plate accommodating portion 7*b*', the channel is formed 5 mm deep and there is 5 mm of material remaining at an upper surface thereof. As shown in section B-B', the plurality of cutout portions 7*d* are formed as vertical through-holes extending from the upper surface through a lower surface of the foam part 7*a*. The plurality of cutout portions 7*d* are formed on the entire foam part 7*a*, including the pad plate accommodating portion 7*b*'. Each of the plurality of cutout portions 7*d* may be configured of the same shape or different shapes (e.g., aesthetics). In this embodiment, for example, the cutout portions are formed in rows of mostly triangular shaped cutouts having rounded edges wherein the shapes of the cutout portions in adjacent rows are formed generally as mirror-images from one another.

It is important to arrange the cutouts in a manner that protects the user (e.g., tactical impact energy dispersion), allows the user's skin to effectively and efficiently breathe and release heat, and reduces the weight of the pads and covering. This can be accomplished by designing a pad with the most amount of cutouts in the padding and covering without compromising the protection to the player (e.g., structural integrity of the pad).

Figure 15:
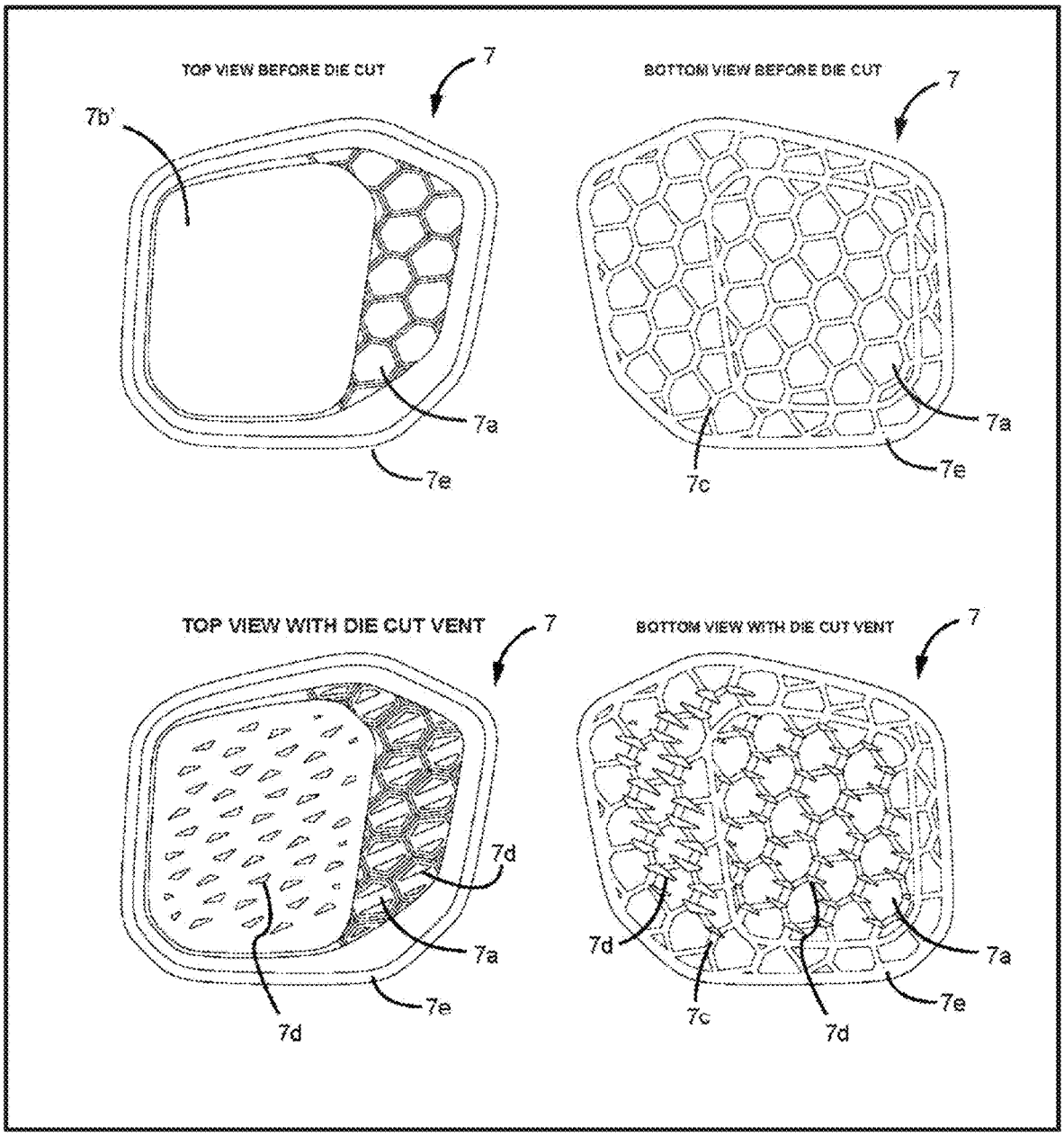
FIG. 15 is a thigh pad foam, before and after die cut in accordance with one embodiment of the invention.

FIG. 15 illustrates a top and bottom view of the left thigh pad foam part 7*a*, before and after a die cut process used to form the plurality of cutout portions 7*d*. As shown in the top view before die cut, the pad plate accommodating portion 7*b*' in this embodiment is a 3 mm recess designed to fit the pad plate 7*b*. The thigh pad 7 includes a stitching tab portion 7*e* formed along the contour of the thigh pad 7. The stitching tab portion 7*e* is preferably formed free of cutout portions 7*d* in order to allow for continuous stitching of the thigh pad 7 to the protective garment 1 along the entire contour of the thigh pad 7.

Figure 19:
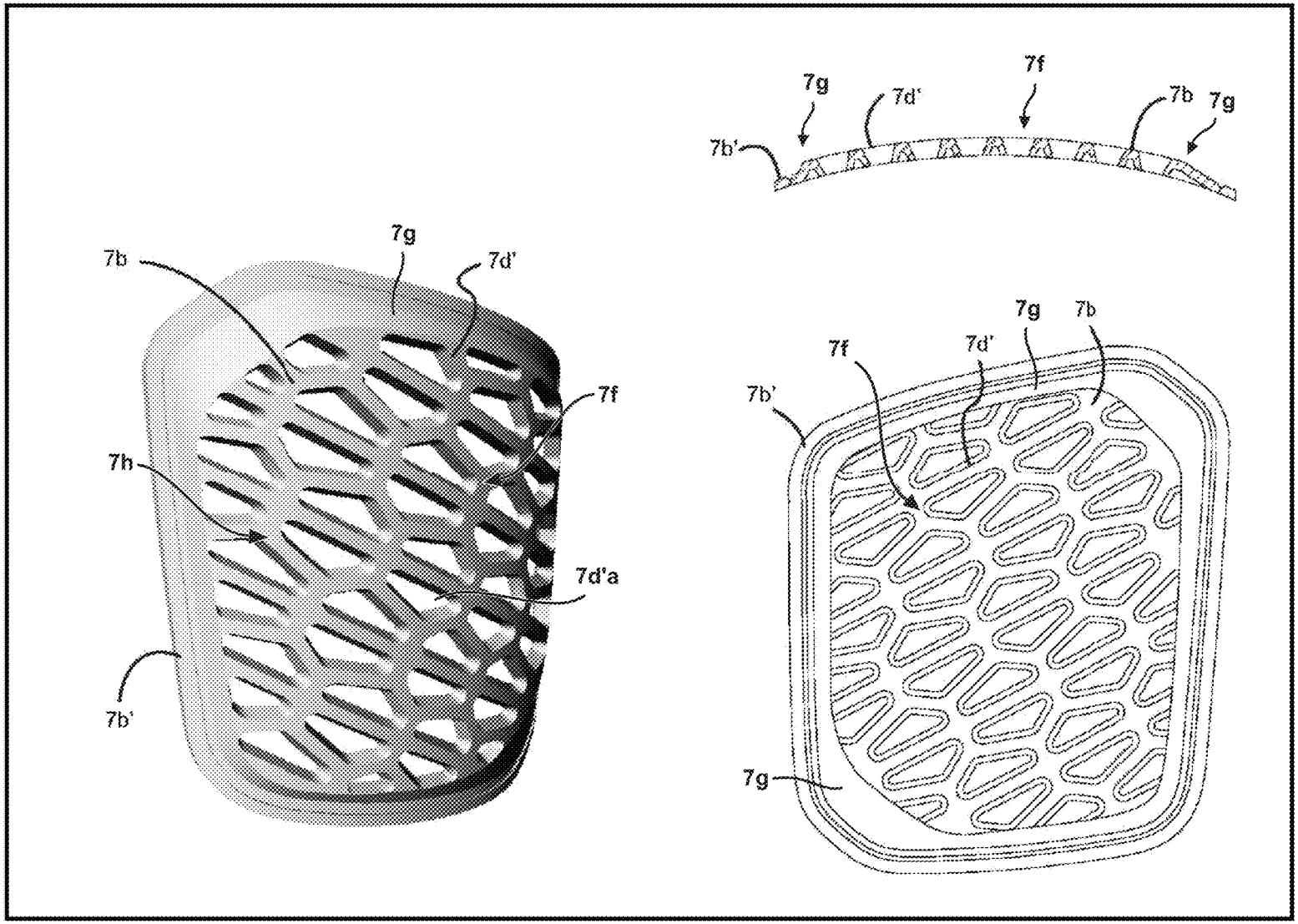
FIG. 19 is a thigh pad plate, including sectional view in accordance with one embodiment of the invention.

FIG. 19 illustrates a thigh pad plate 7*b*. The thigh pad plate 7*b* is arranged (e.g., stitched) on a top of pad plate accommodating portion 7*b*'. The thigh pad plate 7*b* may be made with a flexible plastic material that has a certain amount of flexibility and that is stitchable for stitching the thigh pad plate 7*b* to the foam part 7*a*. The thigh pad plate 7*b* may alternatively include holes formed on a contour thereof to allow for stitching the pad plate 7*b* to the foam part 7*a*. However other known attaching means can be used to attach the pad plate 7*b* to the foam part 7*a*. For example, the pad plate 7*h* may be inserted into pockets on the foam part 7*a* or protective garment 1.

The thigh pad plate 7*b* may be formed from a known hard plastic material, such as ABS, PP, HDPE, PC, or a composite (glass or carbon based), any of blend of these resins, or any of these resins mixed with 0-15% glass or carbon reinforcement. A second plurality of spaced-apart cutout portions 7*d*' is formed in a central section 7*f* of the thigh pad plate 7*b*, which may be surrounded by an outer edge 7*g* of the thigh pad plate. As shown in FIG. 19, the outer edge 7*g* does not include the spaced-apart cutout portions 7*d*'. The pad plate 7*b* is located on a surface of the thigh pad 7 so that each of the cutout portions 7*d*' are arranged generally in line with the corresponding underlying cutout portions 7*d* of the foam part 7*a*, as shown in FIGS. 1, 2, and 6-10. The cutout portions 7*d*' of the thigh pad plate and the cutout portions of the foam part 7*a* may be formed in a grid pattern. For example, an exemplary cutout portion 7*d*'a may be spaced apart from the outer edge 7*g* of the thigh pad plate 7*b*, such that the cutout portion 7*d*'a is situated entirely within the central section 7*f* of the thigh pad plate. According to this embodiment, each of the cutout portion 7*d*' is formed to taper inward. Each cutout portion 7*d*' is spaced apart approximately 6 mm from each adjacent cutout portion 7*d*' and is approximately 6 mm in depth. However, a dimension suitable to mate with the corresponding foam part 7*a* and to provide adequate structural integrity for the desired impact absorption properties can be used.

Figure 7:
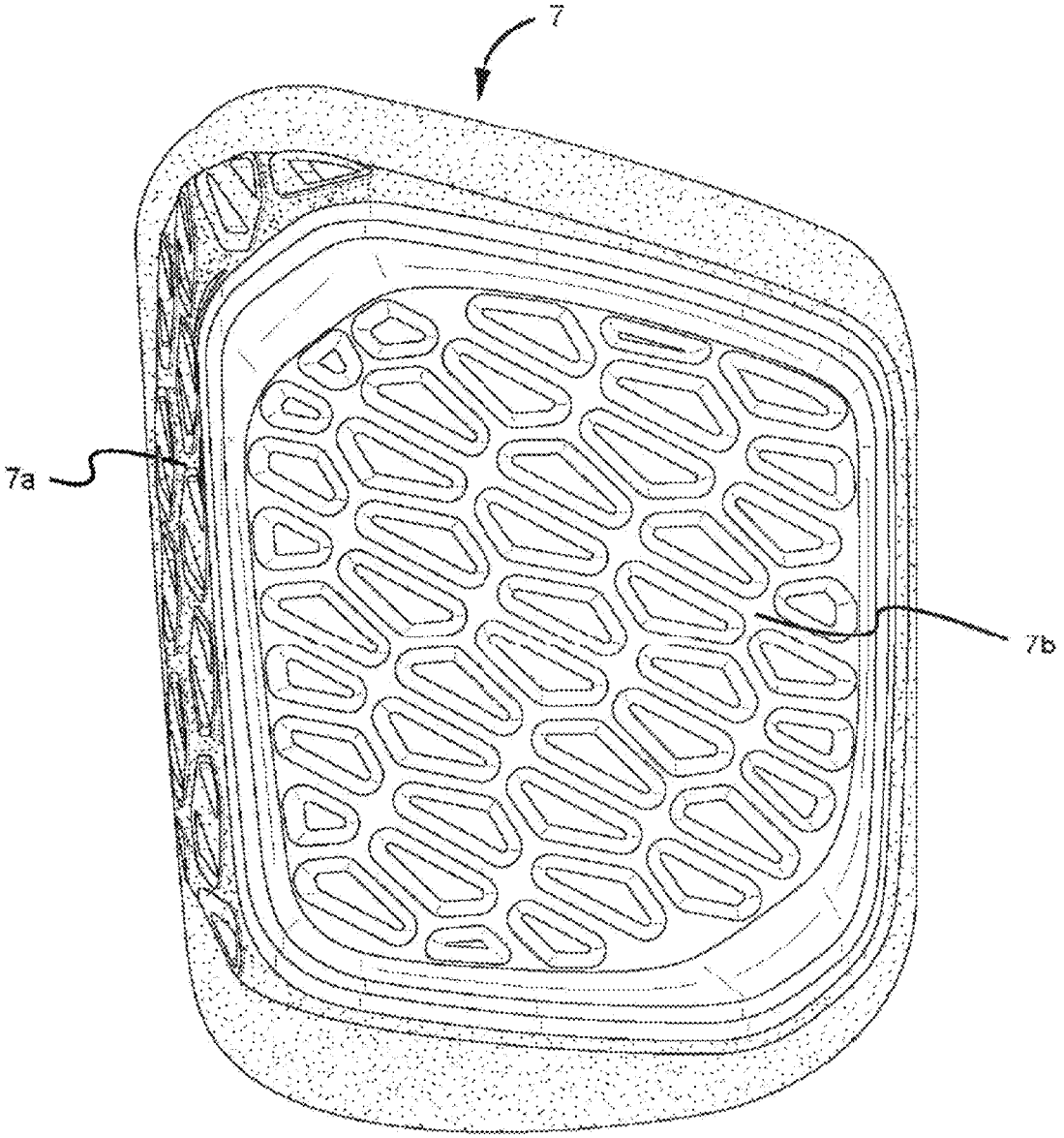
FIG. 7 is a front view of the thigh pad shown in FIG. 6 in accordance with one embodiment of the invention.
Figure 8:
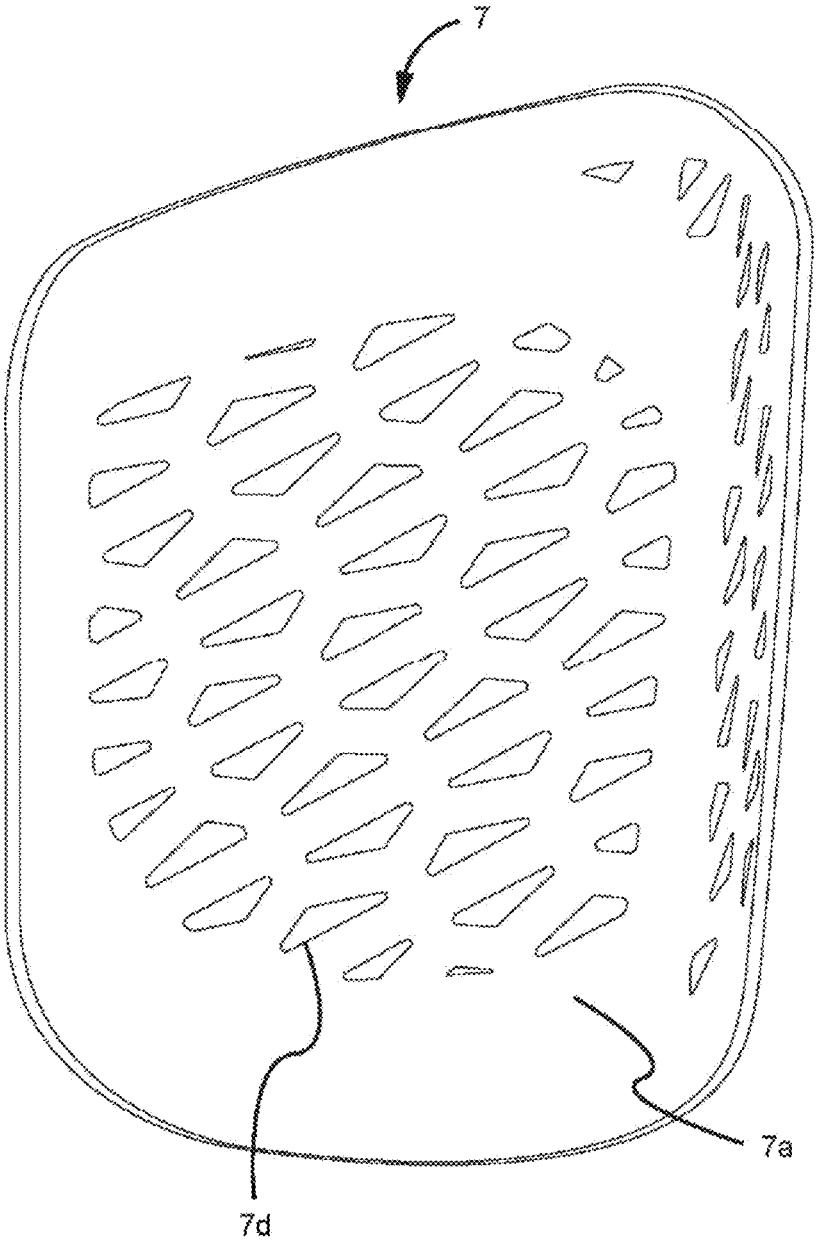
FIG. 8 is a back view of the thigh pad shown in FIG. 6 in accordance with one embodiment of the invention.
Figure 9:
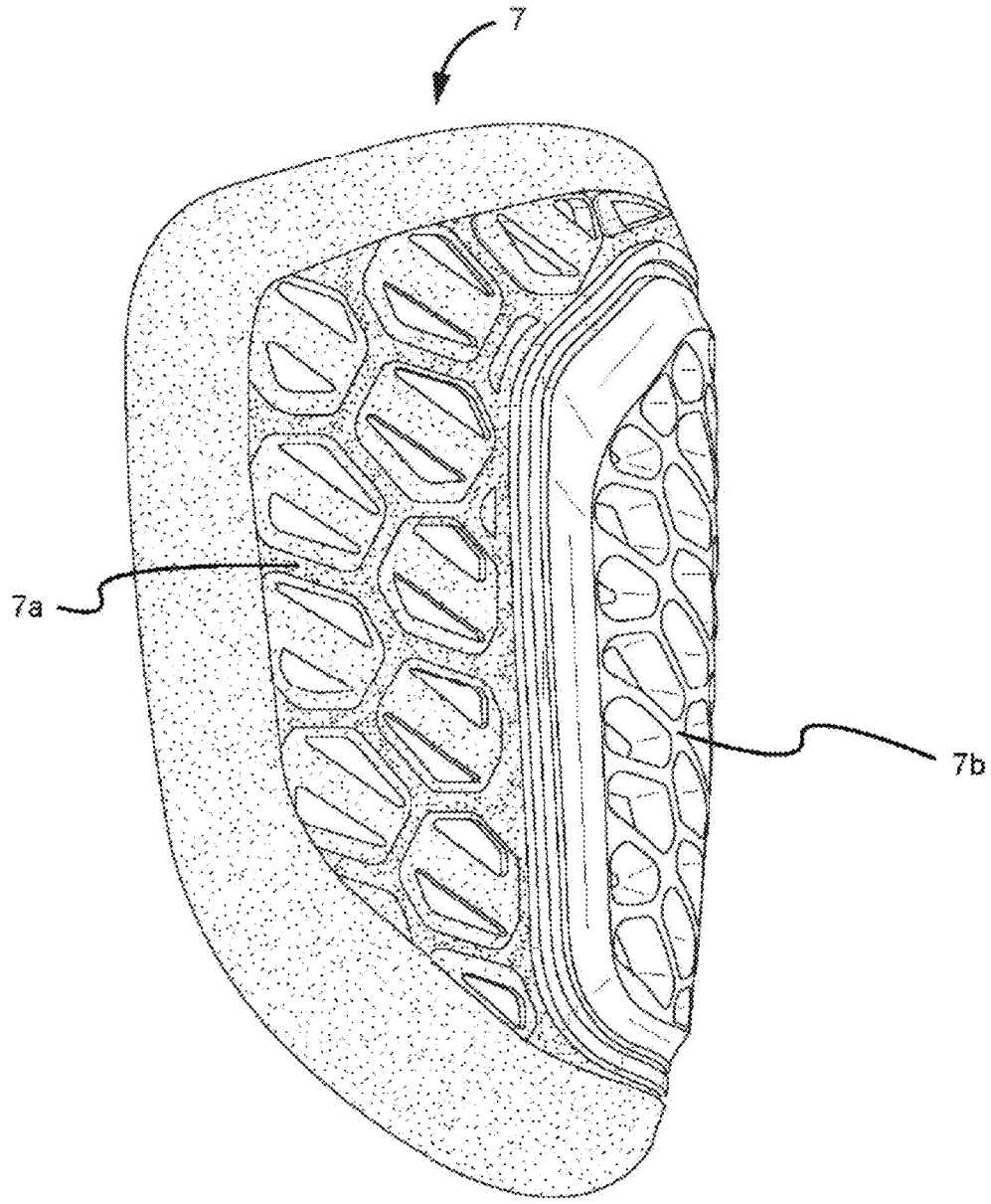
FIG. 9 is a left side view of the thigh pad shown in FIG. 6 in accordance with one embodiment of the invention.
Figure 10:
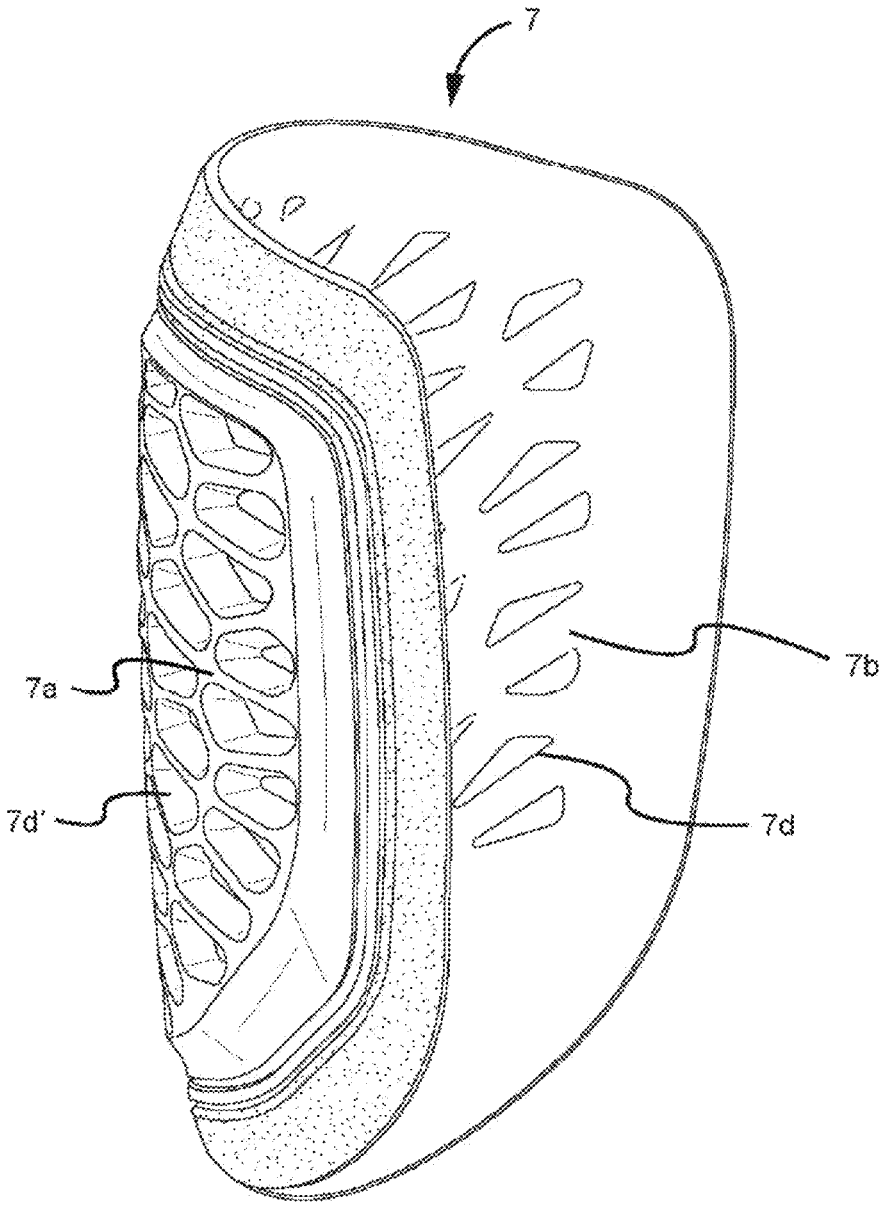
FIG. 10 is a right side view of the thigh pad shown in FIG. 6 in accordance with one embodiment of the invention.
Figure 11:
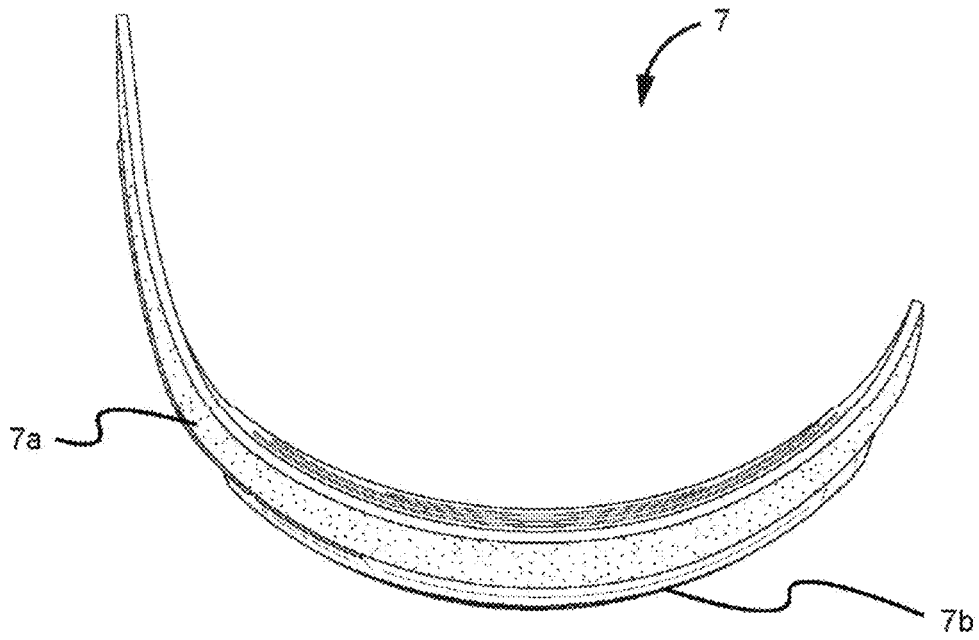
FIG. 11 is a top view of the thigh pad shown in FIG. 6 in accordance with one embodiment of the invention.
Figure 12:
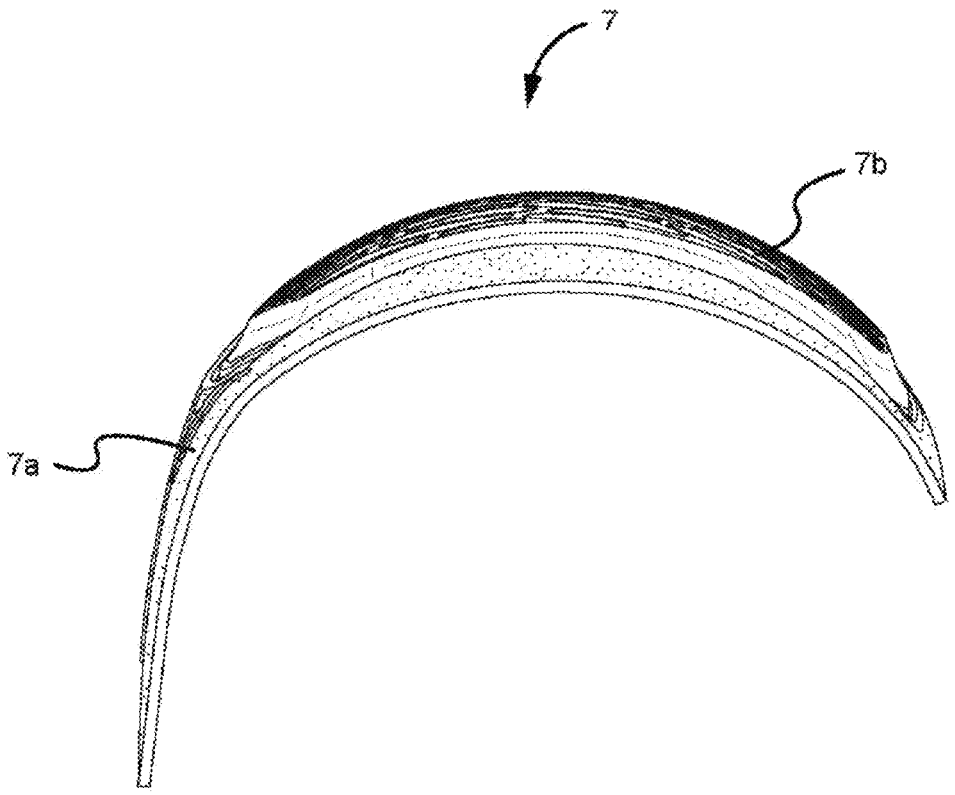
FIG. 12 is a bottom view of the thigh pad shown in FIG. 6 in accordance with one embodiment of the invention.

The cutout portions 7*d*' of pad plate 7*b* provide a large amount of ventilation while still providing strength for impact protection. As shown in FIG. 7, the cutout portions 7*d*' of the pad plate 7*b* provide a certain opening percentage relative to the total surface in a zone defined by the outer perimeter of the pad plate 7*b* cutout portions 7*d*'. FIG. 8 shows the inner surface of the foam part. In FIG. 8, the inner openings of the cutout portions of the pad plate 7*b* correspond with the cutout portions of the foam part 7*a* excluding the cutout portions grouped together along the right edge of the foam part.

The opening percentage calculated based on the inner openings of cutout portions 7*d*' relative to the total surface in the zone defined by the outer perimeter of the cutout portions 7*d*' of pad plate 7*b* on the inner surface (leg side) is preferably 10% or more preferably 15% or more, more preferably 20% or more. The opening percentage of the inner opening of cutout portions 7*d*' is preferably 50% or less, more preferably 40% or less, more preferably 30% or less, more preferably 25% or less. FIG. 7 shows an opening percentage of 22% for the inner openings of cutout portions 7*d*' relative to the total surface in the zone defined by the outer perimeter of the cutout portions 7*d*' of pad plate 7*b*.

The channels in the thigh pad plate 7*b* provide ventilation and also disperse impact energy to the foam part 7*a* more efficiently than a solid hard plate. Moisture-wicking technology in the fabric of the protective garment 1 is designed to remove sweat and to accelerate evaporation and cooling. Mesh panels, e.g., polyl spandex, enhance ventilation to keep the user's core body temperature generally consistent and cool. Compression fabric portions of the protective garment are provided to contour to the user's body for optimal fit and improved range of motion. Flat seam, design of the protective garment 1 is designed to diminish irritation during movement. The protective garment 1 and pads may include anti-microbial treatment to reduce odor causing bacteria.

Figure 16:
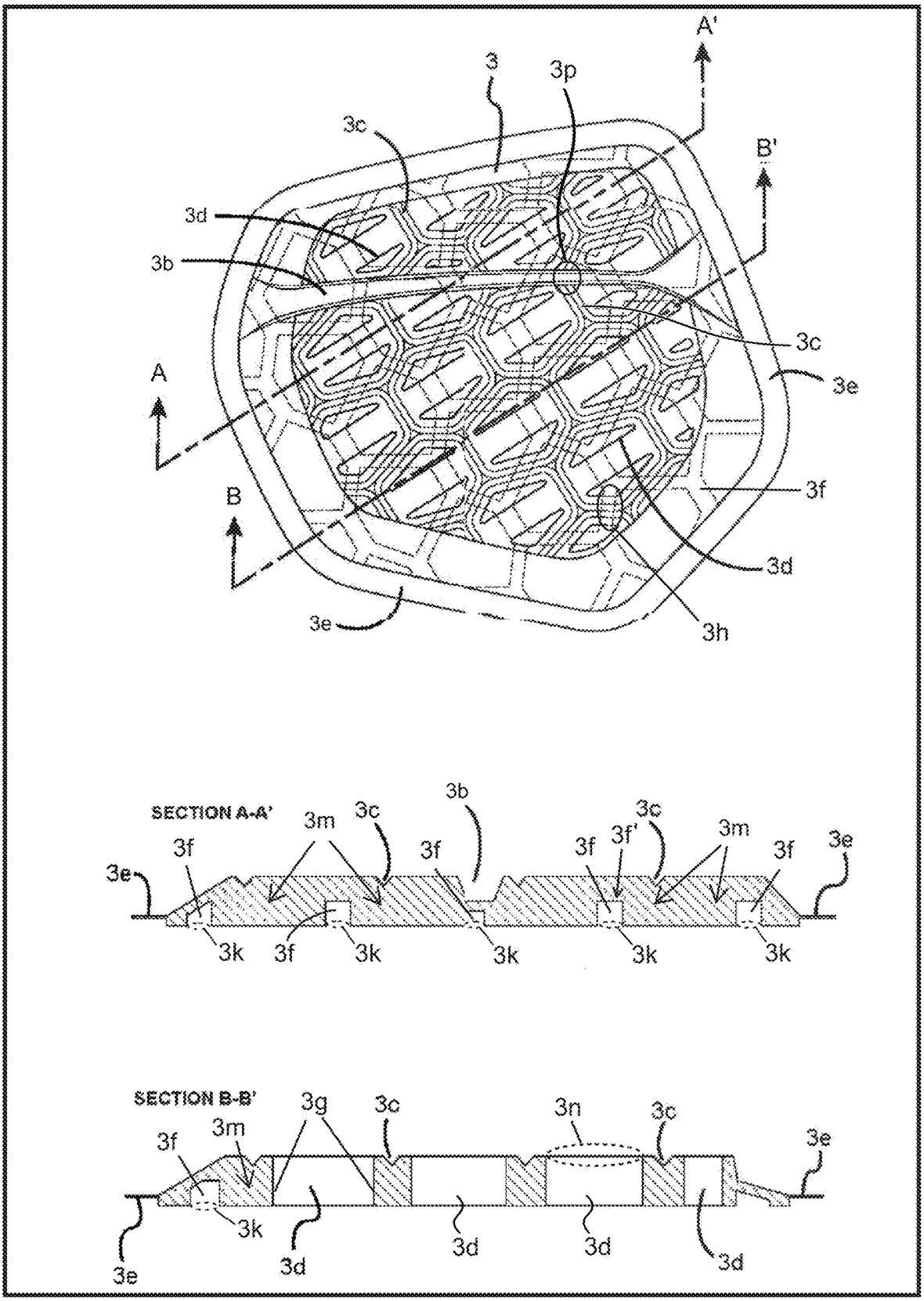
FIG. 16 is a hip pad, including sectional views A-A' and B-B' in accordance with one embodiment of the invention.

FIG. 16 illustrates a left side hip pad 3. As shown in section A-A', the hip pad 3 is formed with a first plurality of channels 3*c* on a first, upper surface of hip pad 3; a second plurality of channels 3*f* on a second, lower surface of hip pad 3; a medial segment 3*m* in between the upper surface and lower surface of hip pad 3; a plurality of cutout portions 3*d*; and a contour stitching tab 3*e*. As illustrated in FIG. 16, the second plurality of channels 3*f* include open ends 3*k* along the second, lower surface of hip pad 3. Medial segment 3*m* separates the first plurality of channels 3*c* from the second plurality of channels 3*f*. As illustrated by circled portion 3*h* in FIG. 16, at least one channel 3*c* in the upper surface may overlap with at least one channel 3*f* in the lower surface (that is, a portion of first channel 3*c* may be directly opposite from a portion of second channel 3*f*). The hip pad 3 may include a horizontal channel 3*b*, preferably 5 mm thick, extending horizontally across the upper surface of hip pad 3 from one end portion of the hip pad 3 to the opposite end portion of the hip pad 3. Horizontal channel 3*b* may intersect with at least one channel of the first plurality of channels 3*c*; an example of an intersection of horizontal channel 3*b* with a channel 3*c* is shown in area 3*p* of FIG. 16. As shown in sections A-A' and B-B', the width of horizontal channel 3*b* may be larger than the width of at least one of the first plurality of channels 3*c* and larger than the width of at least one of the second plurality of channels 3*f*. The thickness of hip pad 3 may be 6-20 mm, preferably 8-12 mm, most preferably 10 mm. Each of the channels 3*f* is preferably 5 mm deep and formed such that at least 2 mm of material of hip pad 3 remains between an inner boundary 3*f*' of the channel (see section A-A') and the upper surface of the pad 3 for structural integrity. For example, in the portion of 10 mm hip pad 3 including a channel 3*f* formed 5 mm deep, the vertical portion of the pad above the channel (specifically, above inner boundary 3*f*' of the channel) is 5 mm thick. As shown in section B-B', the plurality of cutout portions 3*d* are formed as vertical through-holes extending from the upper surface through the medial segment 3*m* to a lower surface of the hip pad 3 with parallel side walls 3*g*. As shown in FIG. 16, the contour stitching tab portion 3*e* is formed along the contour of the hip pad. The stitching tab portion 3*e* is preferably formed free of cutout portions 3*d* in order to allow for continuous stitching of the hip pad 3 to the protective garment 1 along the entire contour of the hip pad 3. Each of the plurality of cutout portions 3*d* may be configured of the same shape or different shapes. In this embodiment, for example, the cutout portions are formed in rows of mostly triangular shaped cutouts having rounded edges wherein the shapes of the cutout portions in adjacent rows are formed generally as mirror-images from one another.

Figure 17:
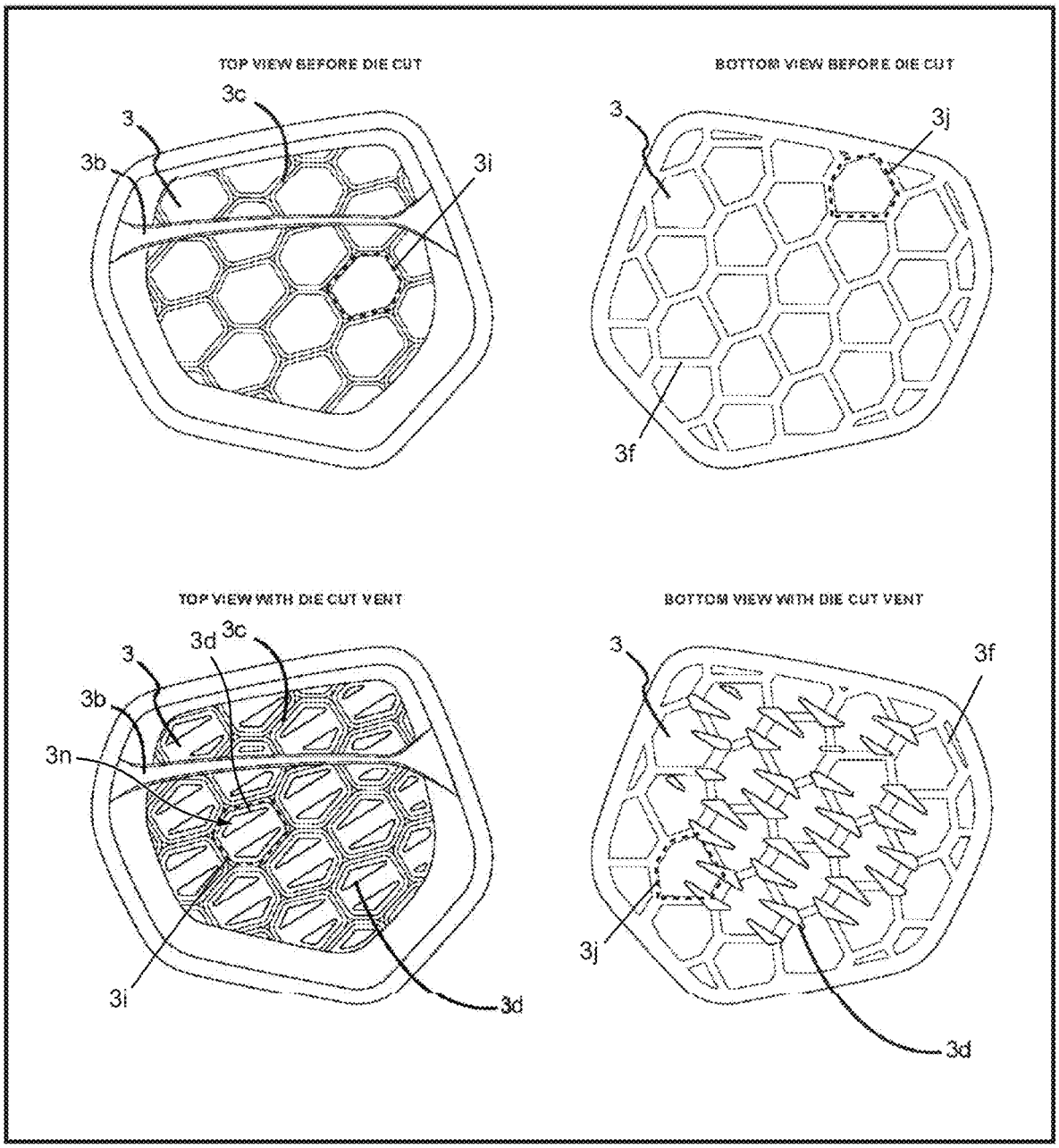
FIG. 17 is a hip pad, before and after die cut in accordance with one embodiment of the invention.

FIG. 17 illustrates a top and bottom view of the left hip pad 3, before and after a die cut process used to form the plurality of cutout portions 3*d*. As shown in the top views, the first plurality of channels 3*c* on the upper surface of hip pad 3 may form a first pattern of closed cells 3*i*. Similarly, and as shown in the bottom views, the second plurality of channels 3*f* on the lower surface of hip pad 3 may form a second pattern of closed cells 3*j*. In the embodiment depicted in FIG. 17, the closed cells 3*i* and 3*j* may have polygonal shapes. As shown in FIG. 17 and section B-B' in FIG. 16, at least one of the cutout portions 3*d* may have an upper opening 3*n* situated within one of the closed cells 3*i* formed by the first plurality of channels 3*c*.

Figure 18:
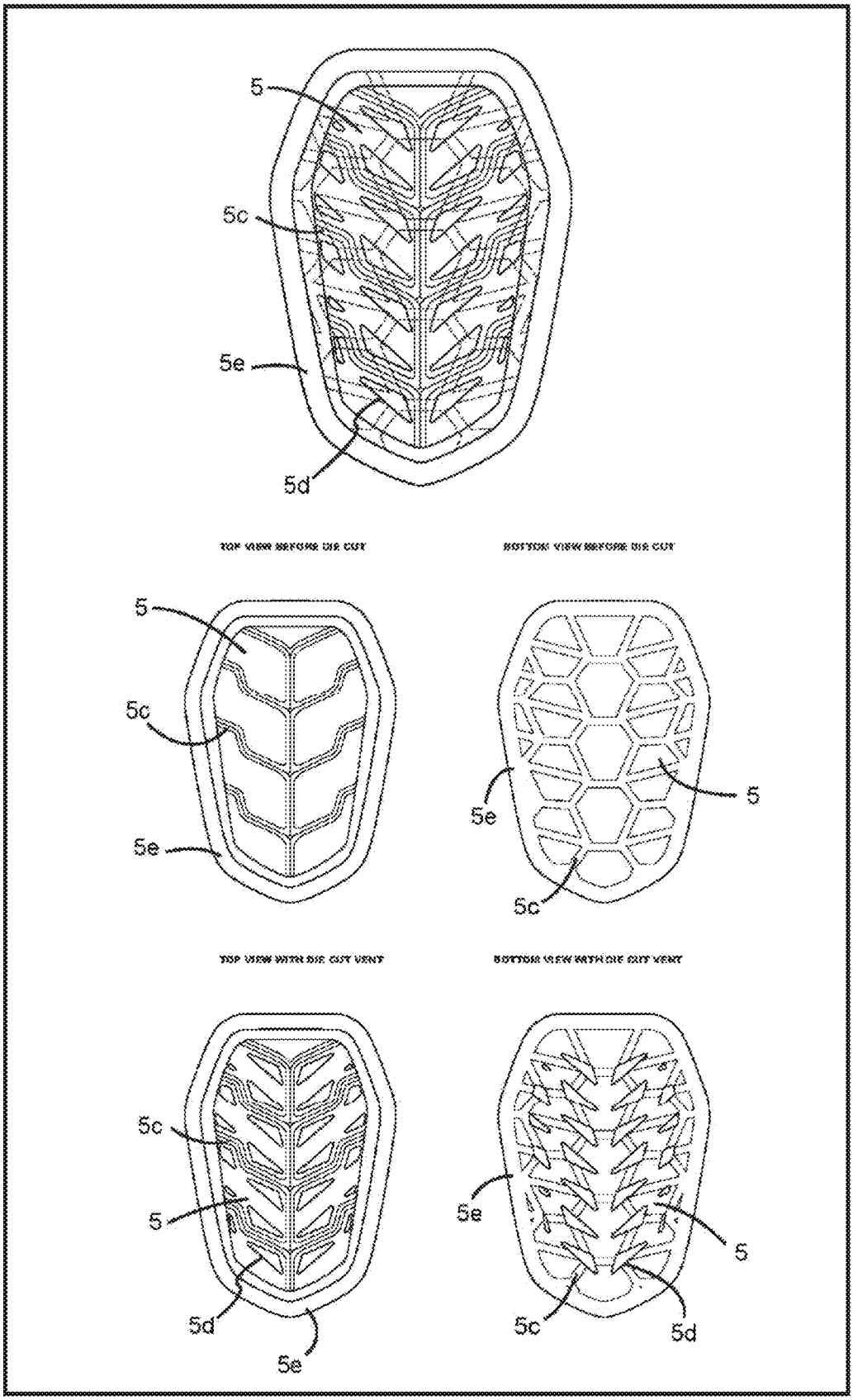
FIG. 18 is a tailbone pad, before and after die cut in accordance with one embodiment of the invention.

FIG. 18 illustrates a tailbone pad 5. The tailbone pad 5 is formed with a plurality of channels 5*c*, a plurality of cutout portions 5*d* and a contour stitching tab 5*e*. The thickness of tailbone pad 5 may be 6-20 mm, preferably 8-12 mm, most preferably 10 mm. Each of the channels 5*c* is preferably 5 mm deep and formed such that at least 2 m of material remains at an upper surface thereof for structural integrity. For example, in a 10 mm portion tailbone pad 5 including a channel formed 5 mm deep, the vertical portion above the channel is 5 mm thick. The plurality of cutout portions 5*d* are formed as vertical through-holes extending from the upper surface through a lower surface of the tailbone pad 5. The contour stitching tab portion 5*e* is formed along the contour of the tailbone pad 5. The stitching tab portion 5*e* is preferably formed free of cutout portions 5*d* in order to allow for continuous stitching of the tailbone pad 5 to the protective garment 1 along the entire contour of the tailbone pad 5. Each of the plurality of cutout portions 5*d* may be configured of the same shape or different shapes. In this embodiment, for example, the cutout portions are formed in rows of mostly triangular shaped cutouts having rounded edges wherein the shapes of the cutout portions in adjacent rows are formed generally as minor-images from one another.

Figure 20:
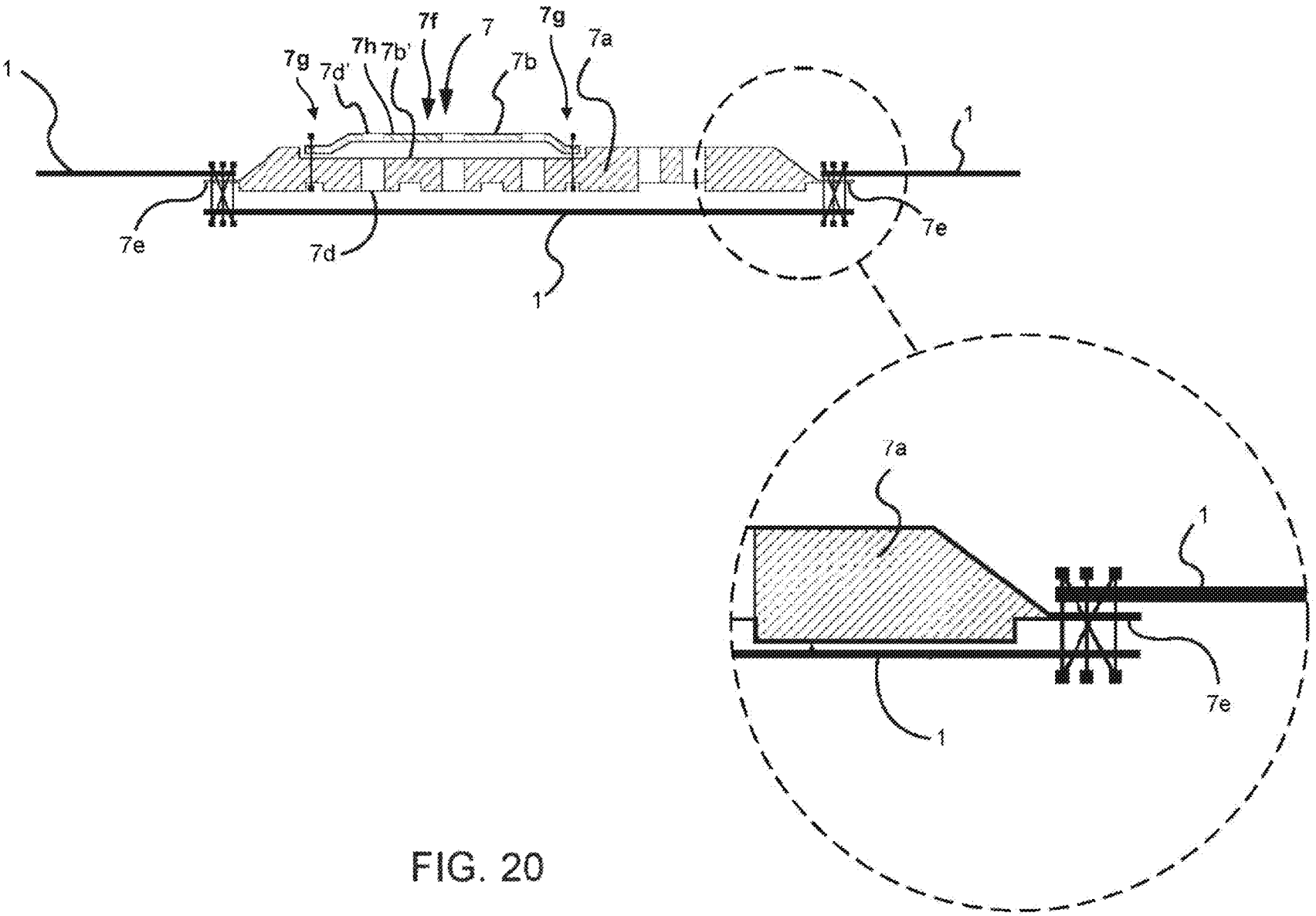
FIG. 20 is an assembly drawing of thigh pad to protective garment in accordance with one embodiment of the invention.

FIG. 20 is a drawing illustrating an assembly of the thigh pad plate 7*b* to the thigh pad foam 7*a*, and the thigh pad 7 to the protective garment 1. As illustrated, the thigh pad plate 7*b* is attached to the pad plate accommodating portion 7*b*' of the foam part 7*a* so that each of the cutout portions 7*d*' are arranged generally in line with the corresponding underlying cutout portions 7*d* of the foam part 7*a*, as shown in FIGS. 1, 2, and 6-10. As shown in FIG. 20, the pad plate 7*b* may be attached to the foam part 7*a* by stitching the outer edge 7*g* of the pad plate 7*b* to pad plate accommodating portion 7*b*' of the foam part 7*a* via the holes formed in the stitching tab portion 7*e*. According to this embodiment, the thigh pad plate 7*b* may be concave such that a portion of the central section 7*f* of the thigh pad plate (e.g., plate portion 7*h* in FIGS. 19 and 20) is spaced apart from the pad plate accommodating portion 7*b*'. The plate portion 7*h* may include the cutout portion 7*d*'a. The thigh pad 7, integrally comprising the foam part 7*a* and plate portion 7*b*, is then attached to the protective garment. The thigh pad 7 may be attached to the protective garment 1 by placing the thigh pad 7 on an inner side of a desired location on the protective garment 1, preferably floating mesh layer, and performing a flatlock (flatseam) contour seam. However, other known methods, such as cover stitching and overlocking may be performed. The hip pad 3 and tailbone pad 5 may also be attached to the protective garment 1 by placing the respective pad on an inner side of a desired location on the protective garment 1, preferably floating mesh layer, and performing a flatlock (flatseam) contour seam.

Illustrative embodiments are described herein with the understanding that the present disclosure is to be considered as providing examples of the principles of the invention and such examples are not intended to limit the invention to preferred embodiments described herein and/or illustrated herein.

What is claimed is:

1. A breathable pad for a protective garment, the pad comprising:

a pad body having an upper surface, a lower surface on an opposite side of the pad body from the upper surface, and a medial segment in between the upper surface and lower surface, wherein the lower surface of the pad body is configured to face towards the user while the upper surface of the pad body faces away from the user;

a first plurality of channels formed in the upper surface of the pad body, the first plurality of channels being arranged in a first pattern to form a first plurality of closed cells in the upper surface of the pad body;

a second plurality of channels formed in the lower surface of the pad body, the second plurality of channels being arranged in a second pattern to form a second plurality of closed cells in the lower surface of the pad body, wherein open ends of the second plurality of channels are configured to face towards the user while the upper surface of the pad body faces away from the user; and a plurality of cutout portions formed as through-holes extending from the upper surface of the pad body through to the lower surface of the pad body, wherein an opening of at least one cutout portion is arranged within a cell of the first plurality of closed cells, and wherein the medial segment of the pad body separates the first plurality of channels from the second plurality of channels, the at least one cutout portion extending through the medial segment of the pad body.

2. The pad of claim 1, wherein the pad is configured as a hip pad.

3. The pad of claim 1, wherein at least one channel in the upper surface of the pad body overlaps with at least one channel in the lower surface of the pad body.

4. The pad of claim 1, wherein at least some of the plurality of cutout portions have the same cross-sectional shape.

5. The pad of claim 1, wherein the plurality of cutout portions have the same cross-sectional shape.

6. The pad of claim 1, wherein the plurality of cutout portions are arranged in rows extending across the pad body.

7. The pad of claim 1, wherein the pad has a thickness of between 8 mm and 12 mm.

8. The pad of claim 1, wherein the pad body includes a portion having a thickness of at least 2 mm, the portion being situated between the upper surface of the pad body and an inner boundary of one of the second plurality of channels.

9. The pad of claim 1, wherein the at least one cutout portion includes parallel side walls, such that a width of the at least one cutout portion remains constant along a length of the at least one cutout portion.

10. The pad of claim 1, wherein at least one of the first plurality of closed cells or the second plurality of closed cells have a polygonal shape.

11. The pad of claim 1, further comprising:

a horizontal channel extending laterally across the upper surface of the pad body, the horizontal channel having a larger width than at least one of the first plurality of channels or the second plurality of channels.

12. The pad of claim 11, wherein the horizontal channel intersects with at least one channel of the first plurality of channels.

13. The pad of claim 1, further comprising:

a stitching tab portion arranged about an outer edge of the pad body, the stitching tab portion being devoid of the plurality of cutout portions.

14. A protective garment for protection from impact forces, the protective garment comprising:

a garment having a body portion and a pair of left and right leg portions; and a protective pad on each of a left and right side of the body portion, the protective pad comprising the pad of claim 1.

* * * * *